US011181861B2

(12) United States Patent
Ohta

(10) Patent No.: US 11,181,861 B2
(45) Date of Patent: Nov. 23, 2021

(54) IMAGE FORMING APPARATUS

(71) Applicant: CANON KABUSHIKI KAISHA, Tokyo (JP)

(72) Inventor: Hideki Ohta, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/938,148

(22) Filed: Jul. 24, 2020

(65) Prior Publication Data

US 2021/0034011 A1 Feb. 4, 2021

(30) Foreign Application Priority Data

Jul. 30, 2019 (JP) ..... JP2019-139598

(51) Int. Cl.
*G03G 21/20* (2006.01)

(52) U.S. Cl.
CPC ..... *G03G 21/206* (2013.01)

(58) Field of Classification Search
CPC ..... G03G 21/206
See application file for complete search history.

(56) References Cited

U.S. PATENT DOCUMENTS

2013/0287413 A1* 10/2013 Akamatsu ..... G03G 15/235 399/21
2016/0349701 A1* 12/2016 Masuta ..... G03G 21/206

FOREIGN PATENT DOCUMENTS

JP 2012-098448 A 5/2012

* cited by examiner

*Primary Examiner* — Thomas S Giampaolo, II
(74) *Attorney, Agent, or Firm* — Venable LLP

(57) ABSTRACT

An image forming apparatus includes an image forming portion for forming a toner image on a sheet, a fixing portion for fixing the toner image formed by the image forming portion on the sheet, a reversing portion for reversing the sheet carrying the toner image fixed by the fixing portion, a blower for blowing air, and a duct for guiding the air blown from the blower to the reversing portion. The duct is provided with an opening at an end in a width direction of the sheet, and the blower blows the air from a downstream side to an upstream side with respect to the feeding direction of the sheet after being reversed by the reversing portion.

10 Claims, 7 Drawing Sheets

IMAGE FORMING APPARATUS

FIELD OF THE INVENTION AND RELATED ART

The present invention relates to an image forming apparatus such as a copying machine, a printer, or the like.

An image forming apparatus such as a copying machine, a printer, or the like transfers an unfixed image onto recording medium such as a sheet of paper, and fixes the unfixed image to the recording medium by applying heat and pressure to the recording medium and the unfixed image thereon with the use of its fixing apparatus. While the recording medium and the unfixed image thereon are heated and pressed by the fixing apparatus, the moisture in the recording medium evaporates, and then, is released as water vapor, into or out of the fixing apparatus.

As the water vapor is released from the recording medium, it condenses on the guiding members of the image forming apparatus, which guide the recording medium as the recording medium is conveyed through the image forming apparatus. Further, it condenses on recording medium conveyance rollers, or the like, of the image forming apparatus. In particular, the downstream side of the fixing apparatus is greater in the amount by which the water vapor condenses than that in the upstream side. This condensation of the water vapor from the recording medium more conspicuously occurs when the main assembly of the image forming apparatus is low in temperature than when it is high. If a sheet of recording medium comes into contact with the portions of the image forming apparatus, on which the water vapor has condensed, a phenomenon that the sheet of recording medium is discharged into the delivery tray while remaining wet occurs. Further, if the image forming apparatus happens to be in the two-sided image formation mode, a phenomenon that the image forming apparatus outputs a print, the second surface of which has an image which is defective in that the portion of the image, which corresponds in position to the wet portion of the sheet of recording medium, is missing, occurs.

Thus, it has been proposed to structure an image forming apparatus so that ambient air is sent by a fan, to its discharging apparatus, which is positioned above its fixing apparatus (Japanese Laid-open Patent Application No. 2012-98448). More specifically, the discharging apparatus is provided with a driving roller and a follower roller, for example. It is also provided with a rotational member (named "corrugation rolls" in the aforementioned document), which is fitted around the axle of the follower roller. This rotational member is shaped so that its lengthwise end portions are protrusive toward the recording medium passage relative to the area of contact between the driving roller and follower roller. It is provided with a recess, through which the air sent by the fan is allowed to flow to be discharged out of the image forming apparatus. With the employment of this structural arrangement, it is possible to prevent the problem that water vapor condensation occurs to the sheet conveyance passage on the downstream side of the fixing apparatus, and also, to the sheet conveyance rollers.

In recent years, an image forming apparatus has been required to be high in operational speed and productivity. Thus, a recording medium remains high in temperature after its passage through a fixing apparatus. In other words, the recording medium is conveyed while releasing water vapor for a while. Thus, a recent image forming apparatus is substantially greater in the amount by which water vapor is released by a recording medium than that in an older one.

Therefore, when a recent image forming apparatus is in the two-sided image formation mode, water droplets adhere to the reverse conveyance sheet passage, and the sheet passage for the two-sided image formation mode, through which the recording medium is conveyed after it is conveyed through the fixing apparatus.

Moreover, if an image forming apparatus is greater in the amount by which water vapor is generated by its fixing apparatus, the water vapor tends to remain in the portion of the internal space of the image forming apparatus, that is on the downstream side of the fixing apparatus. If the amount of the water vapor in this space exceeds the dew point, the water vapor turns into minute water droplets (steam), which are visible. In particular, the spaces adjacent to the sheet discharge opening are covered with parts of the external wall of the main assembly of the image forming apparatus, being therefore very small. Therefore, the water vapor in these spaces is likely to exceed the dew point. Therefore, minute water particles are likely to be generated in these spaces. As the steam (collection of minute water droplets) generated in these space exits from the image forming apparatus through the sheet discharge opening, it is possible that as a user sees the steam coming out of the image forming apparatus through the sheet discharge opening, the user might misunderstand that the image forming apparatus is malfunctioning.

By the way, according to the prior art, air is sent by a fan throughout the entirety of the discharging apparatus in terms of the direction perpendicular to the recording medium conveyance direction. That is, it does not occur that air is exclusively sent to the space in the adjacencies of the lateral edge portions of the narrow sheet discharge opening, in which water vapor is likely to exceed the dew point. Therefore, it was possible that the steam (collection of minutes water droplets) will come out of the image forming apparatus through the discharge opening.

SUMMARY OF THE INVENTION

The present invention can solve the aforementioned problem. Thus, an object is to provide an image forming apparatus which can prevent a recording medium from being wetted by the water attributable to condensation, and therefore does not output an unsatisfactory image attributable to the wetting of recording medium, and also, can prevent the steam or visible vapor, which results from condensation, from coming out of its sheet discharge opening, and therefore, can prevent the problem that a user who notices steam coming out of the sheet discharge opening might misunderstand that the image forming apparatus is malfunctioning.

According to an aspect of the present invention, there is provided an image forming apparatus comprising an image forming portion for forming a toner image on a recording material; a fixing portion configured to fix the toner image formed by said image forming portion, on the recording material; a reversing portion configured to reverse the recording material carrying the toner image fixed by the fixing portion; a blower configured to blow air; and a duct for guiding the air blown from the blower means to said reversing means, wherein said duct is provided with an opening at an end in a width direction of the recording material, and said blower blows the air from a downstream side to an upstream side in the feeding direction of the recording material after being reversed by said reversing portion.

Further features of the present invention will become apparent from the following description of exemplary embodiments with reference to the attached drawings.

DESCRIPTION OF THE EMBODIMENTS

In the following, the present invention is concretely described with reference to preferred embodiments of the present invention.

Embodiment 1

First, referring to FIGS. 1-6, the image forming apparatus in the first embodiment of the present invention is described about its structure.

<Image Forming Apparatus>

Figure 1:
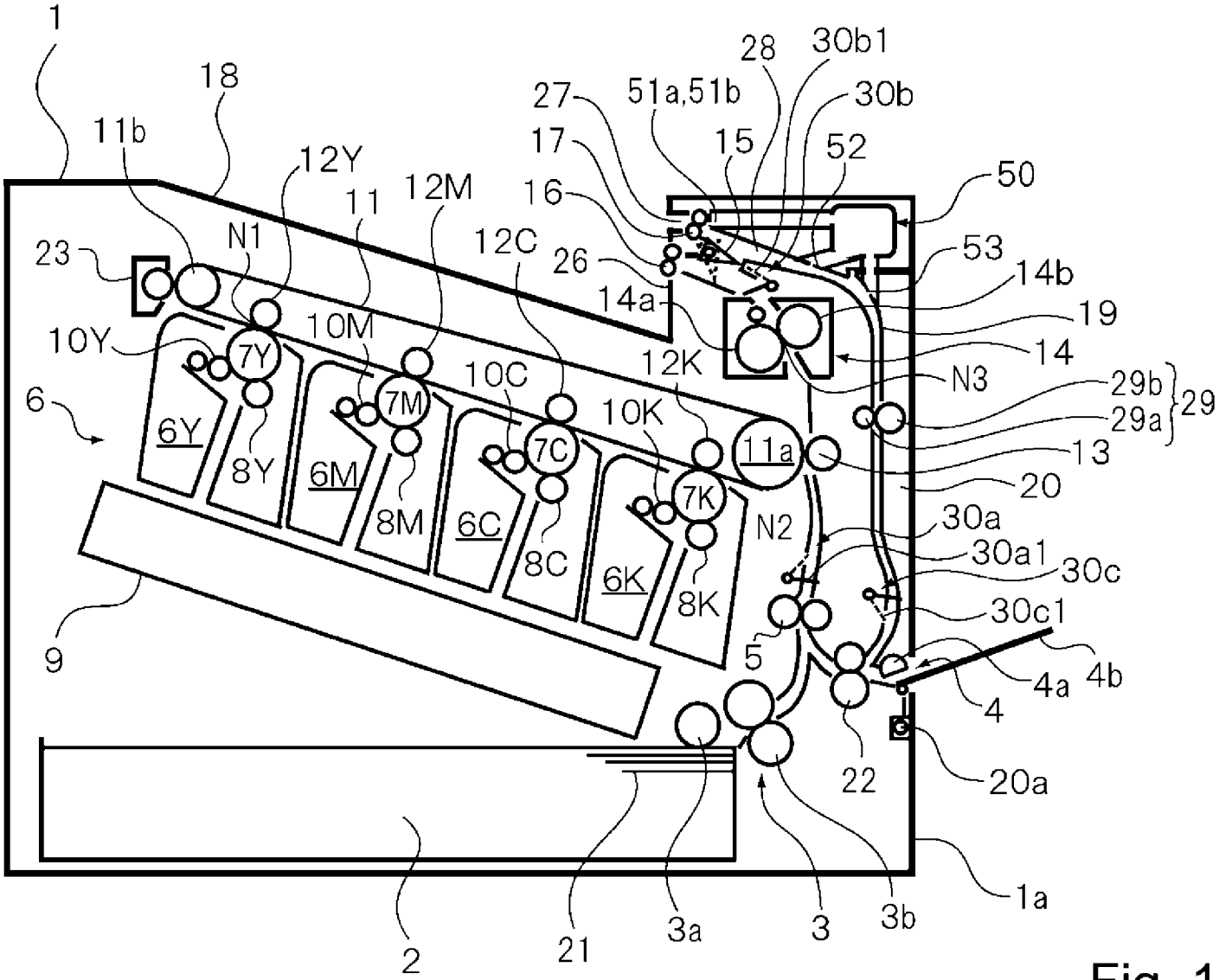
FIG. 1 is a sectional view of a typical image forming apparatus to which the present invention is applicable; it shows the structure of the apparatus.

To begin with, referring to FIG. 1, the image forming apparatus 1 is described about its structure. FIG. 1 is a sectional view of the image forming apparatus 1. It shows the structure of the image forming apparatus 1. The image forming apparatus 1 shown in FIG. 1 is an example of an electrophotographic full-color laser beam printer, which is provided with two or more photosensitive drums 7 as image bearing members. By the way, the present invention is also applicable to a monochromatic copying machine, or a monochromatic printer, which is provided with only one photosensitive drum 7. That is, the application of the present invention is not limited to a full-color laser beam printer.

The bottom portion of the image forming apparatus 1 shown in FIG. 1 is provided with a sheet feeder cassette 2, in which multiple sheets of recording medium are storable, and which can be pulled out of, or pushed back into, the main assembly 1*a* of the image forming apparatus 1. Further, the bottom portion of the image forming apparatus 1 is provided with a sheet feeding portion 3, which is positioned in the adjacencies of the end portion of the sheet feeder cassette 2 in terms of the direction in which a sheet of recording medium is fed into the apparatus main assembly 1*a*. Further, the image forming apparatus 1 is provided with a manual sheet feeding portion 4, which corresponds in position to the right-hand side of FIG. 1.

The sheet feeding portion 3 is provided with a feed roller 3*a* and a pair of separation rollers 3*b*. The sheets 21 of recording medium in the sheet feeder cassette 2 are pushed out of the cassette 2 by the feed roller 3*a*, with the topmost one being separated from the rest by the pair of separation rollers 3*b*. The manual sheet feeder portion 4 is provided with a feed roller 4*a*. As sheets 21 of recording medium are placed in layers on the manual sheet feeder tray 4*a*, they are fed into the main assembly 1*a* of the image forming apparatus 1 by the feed roller 4*a*, while being separated one by one from the rest.

As a sheet 21 of recording medium is fed into the apparatus main assembly 1*a* from the sheet feeder cassette 2 by the sheet feeding portion 3, it is conveyed further into the apparatus main assembly 1*a* until its leading edge comes into contact with the nip of a pair of registration rollers 5 while the rollers 5 are remaining stationary. Thus, it is corrected in attitude if it was being conveyed askew. On the other hand, as a sheet 21 of recording medium in the manual feeder tray 4*b* is fed into the apparatus main assembly 1*a* by the manual feeding portion 4, it is conveyed by a conveyance roller 22 until its leading edge comes into contact with the nip of the pair of registration roller 5, being thereby corrected in attitude if it was being conveyed askew. There is disposed a sheet sensor 30*a* on the downstream side of the pair of registration rollers 5. As the sheet 21 of recording medium is conveyed along the sheet sensor 30*a*, the flag 30*a*1 of the sheet sensor 30*a* is pushed upward by the sheet 21, being thereby made to pivot upward. As the flag is made to pivot upward to a position indicated by a dotted line, an unshown control portion determines that the sheet 21 is being correctly conveyed.

The image forming apparatus 1 is provided with four image forming stations which are aligned in tandem. The four image forming stations are provided with image forming portions 6Y, 6M, 6C and 6K, as image forming means, for forming yellow, magenta, cyan and black toner images on a sheet 21 of recording medium, one for one (FIG. 1). Hereafter, by the way, each of the image forming portions 6Y, 6M, 6C and 6K may be described as an image forming portion 6. This method of describing each of the image forming stations 6Y, 6M, 6C and 6K simply as an image forming station 6 applies to image forming means as well.

Each image forming portion 6 is provided with a photosensitive drum 7, which rotates in the clockwise direction of FIG. 1, and a charge roller 8 as a charging means for uniformly charging the peripheral surface of the photosensitive drum 7. Further, it is provided with a scanner unit 9, which forms an electrostatic latent image on the peripheral surface of the photosensitive drum 7, by projecting a beam of laser light upon the peripheral surface of the photosensitive drum 7, while modulating the beam with the information of the image to be formed. Moreover, it is provided with a developing apparatus 10, which develops the electrostatic latent image formed on the peripheral surface of the photosensitive drum 7, into a toner image, by adhering toner, as developer, to the electrostatic latent image. Further, it is provided with a primary transfer roller 12, as the first transferring means, which transfers the toner image on the peripheral surface of the photosensitive drum 7, onto an intermediary transfer belt 11.

The intermediary transfer belt 11 is positioned so that it is rotatable in the counterclockwise direction of FIG. 1 by a combination of a pair of suspending-tensioning rollers 11*a* and 11*b*. Each primary transfer roller 12 is positioned on the inward side of the loop which the intermediary transfer belt 11 forms, in such a manner that it opposes the corresponding photosensitive drum 7. The area of contact between the photosensitive drum 7 and the outward surface of the intermediary transfer belt 11 is the primary transfer nip N1, in which the toner image on the photosensitive drum 7 is transferred onto the outward surface of the intermediary transfer belt 11; the four toner images formed in the four image forming portions, one for one, are sequentially transferred in layers onto the intermediary transfer belt 11. The toner remaining on the peripheral surface of the photosensitive drum 7 after the primary transfer is removed by a cleaner 23 as a cleaning means.

The toner image borne on the outward surface of the intermediary transfer belt 11 is sent by the rotation of the intermediary transfer belt 11, to the secondary transfer nip N2 formed by the outward surface of the intermediary transfer belt 11, and the secondary transfer roller 13 as the secondary transferring means. In the secondary transfer nip N2, the toner images borne on the outward surface of the intermediary transfer belt 11 are transferred together onto the sheet 21 of recording medium conveyed to the secondary transfer nip N2 by the pair of registration rollers 5. The residual toner remaining on the outward surface of the intermediary transfer belt 11 after the transfer is removed by the cleaner 23 as a cleaning means.

Thereafter, the toner images borne on the sheet 21 of recording medium are fixed to the sheet 21 by a fixing apparatus 14 as a fixing means. The fixing apparatus 14 fixes the toner images formed by the image forming portions 6, to the sheet 21. The fixing apparatus 14 is provided with a heating unit 14*a* and a pressure roller 14*b*. The pressure roller 14*b* is kept pressed on the heating unit 14*a*, forming a fixation nip N3 between itself and the heating unit 14*a*. As the solenoid 21, on which the toner images are borne, is conveyed through the fixation nip N3, the sheet 21 and the toner images thereon are heated and pressed. As a result, the toner images become fixed to the sheet 21.

There is disposed a sheet sensor 30*b* on the downstream side of the fixing apparatus 14. As the flag 30*b*1 of the sheet sensor 30*b* is pushed up by the sheet 21, being thereby made to pivot to a position indicated by a dotted line in FIG. 1, the unshown control portion determines that the sheet 21 is being correctly conveyed. Thereafter, if a flapper 15 is in the position indicated by a solid line in FIG. 1, the sheet 21 is guided to the pair of discharge rollers 16 located diagonally above the left end portion (FIG. 1) of the fixing apparatus 14, as the sheet 21 comes out of the fixing apparatus 14. After being conveyed toward the pair of discharge rollers 16, the sheet 21 is discharged onto a delivery tray 18.

If the flapper 15 is in the position indicated by the broken line in FIG. 1 after being pivotally moved in the clockwise direction of FIG. 1, the sheet 21 is guided to a reversal roller 17 which is above the top-left side of the fixing apparatus 14, and also, above the pair of discharge rollers 16, after being discharged from the fixing apparatus 14. The reversal roller 17, as a means for reversing a sheet 21 of recording medium in conveyance direction is structured as a means which flips the sheet 21 upside down, with the use of a reverse conveyance passage 28 positioned above the fixing apparatus 14, after the fixation of the toner images to the sheet 21.

After being conveyed to the reverse roller side, the sheet 21 is conveyed by the reversal roller 17 which rotates in the positive direction, or the direction for discharging the sheet 21 onto the delivery tray 18 through the discharge opening 27. Thereafter, the reversal roller 17 begins to be rotated in reverse while the trailing end portion of the sheet 21 is remaining pinched by the pair of reversal rollers 17. Thus, the sheet 21 is reversed in the conveyance direction, and is conveyed in the rightward direction of FIG. 1 toward a two-sided image formation passage 19, which guides the sheet 21 toward the image forming portion 6 for the second time.

<Sheet Conveyance Passages>

Figure 2:
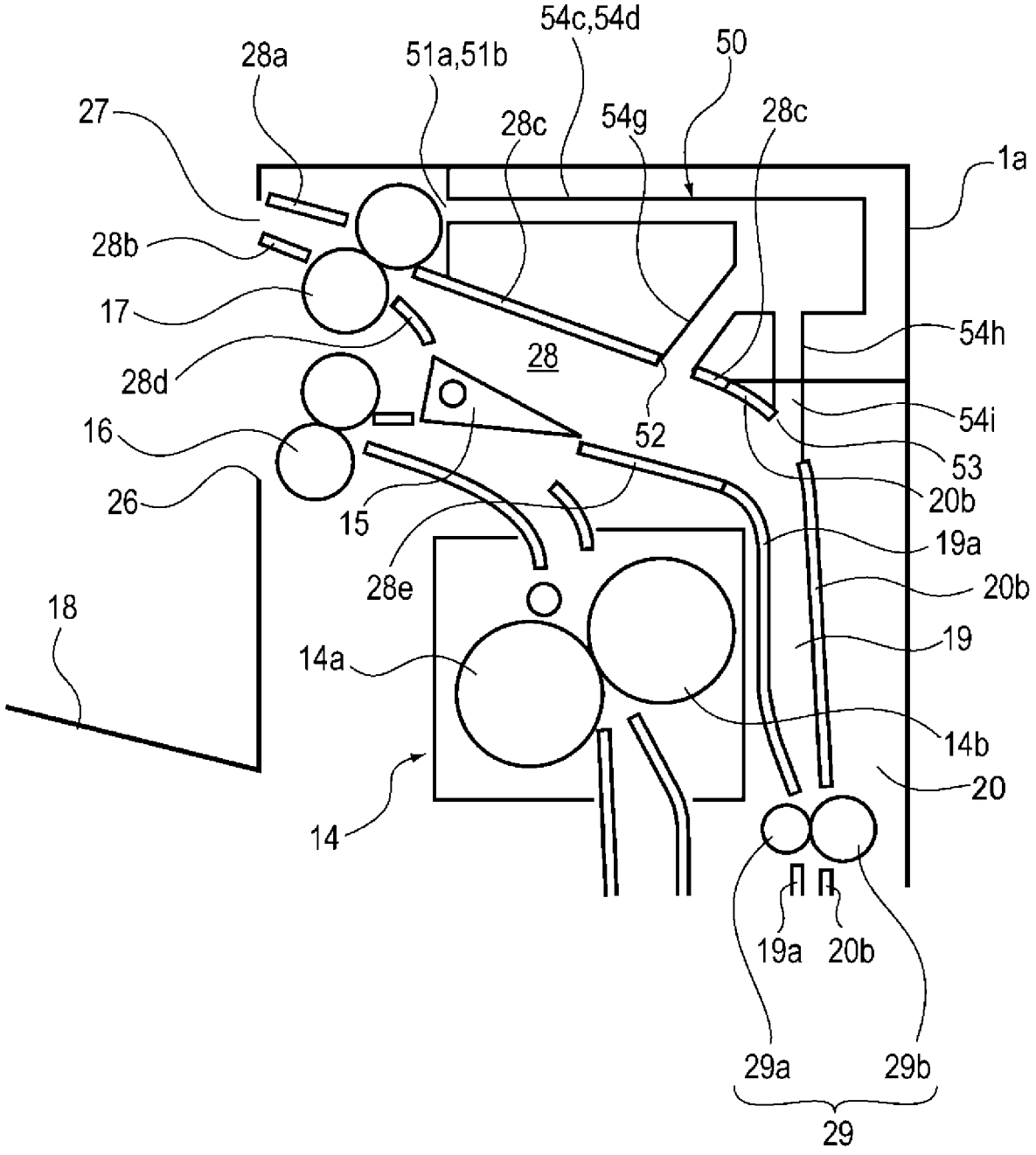
FIG. 2 is a sectional view of the portion of the image forming apparatus in the first embodiment of the present invention, which is above the fixing apparatus of the image forming apparatus; it shows the structure of this portion.

Next, referring to FIGS. 1 and 2, the sheet passage which guides the sheet 21 to the image forming portion 6 for the second time after the sheet 21 is flipped upside down is described. FIG. 2 is a sectional view of the top-right portion of the fixing apparatus 14. It shows the structure of the top-right portion. The reversal conveyance passage 28 shown in FIGS. 1 and 2 is positioned above the fixing apparatus 14. It extends horizontally rightward from the reversal roller 17. It comprises the reversal roller 17, and sheet guides 28*a*-28*e* which guide the sheet 21 by the top and bottom surfaces of the sheet 21, etc.

The two-sided image formation passage 19 shown in FIG. 1 is positioned and shaped so that it extends downward of the image forming apparatus 1 along the fixing apparatus 14. It is in connection to the reversal conveyance passage 28, and positioned so that it extends along the fixing apparatus 14, and then, vertically extends downward in the right side portion of the FIGS. 1 and 2. The two-sided image formation passage 19 comprises a combination of a sheet guide 19*a* and a driving roller 29*a*, shown in FIG. 2, with which the apparatus main assembly 1*a* is provided to guide the sheet 21 by the top and bottom surfaces of the sheet 21, and a combination of a sheet guide 20*b* and a follower roller 29*b*, with which the door 20 is provided, etc.

Figure 4:
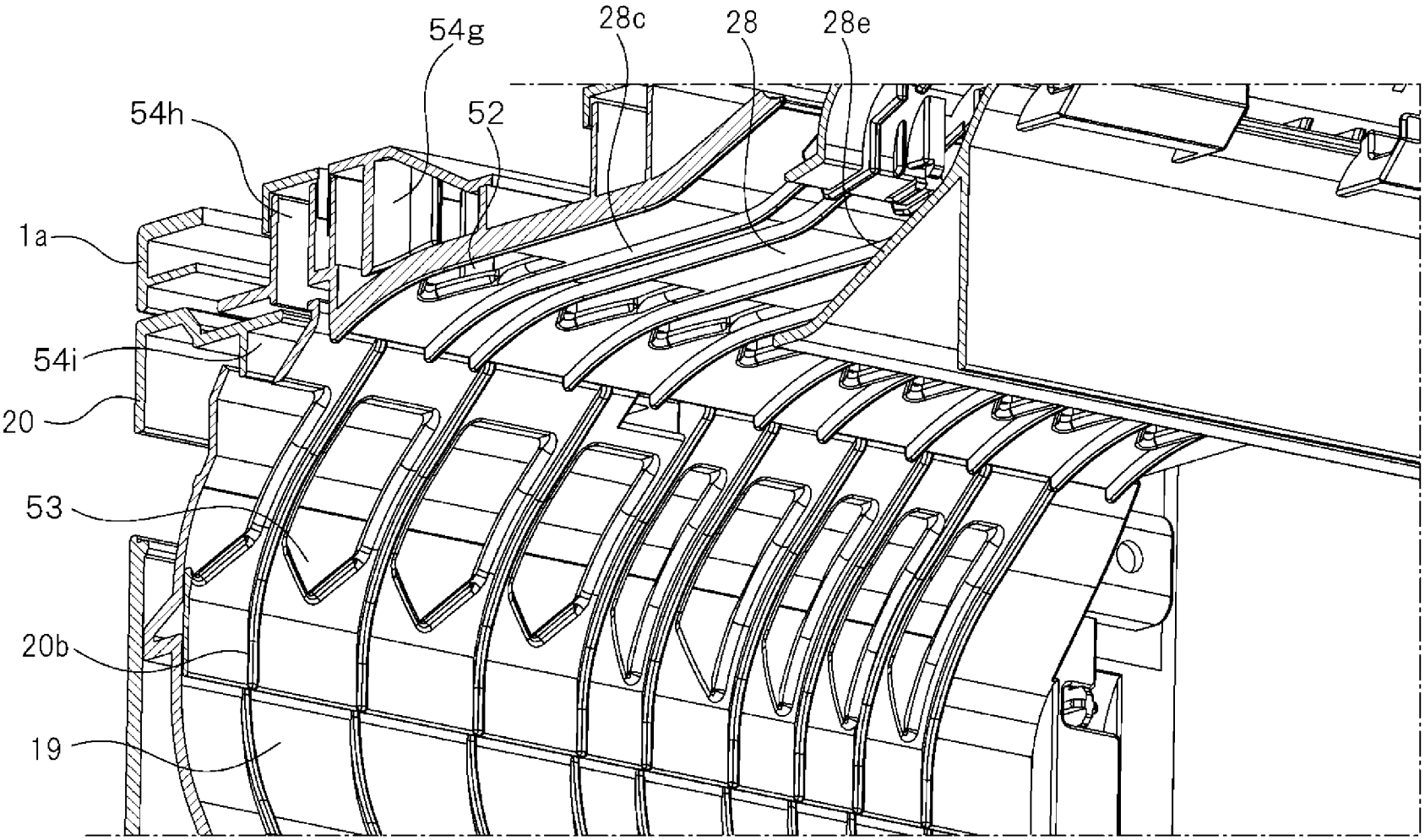
FIG. 4 is a sectional view of the portion of the image forming apparatus, which is shown in FIG. 3, at a plane A-A in FIG. 3.

Referring to FIG. 1, the right side of the image forming apparatus 1 is provided with the door 20 which makes it possible to expose the two-sided image formation passage 19. The door 20 is pivotally movable about its hinge portion 20*a* to be opened away from, or shut against, the apparatus main assembly 1*a*. Referring to FIG. 2, the inward side of the door 20 is provided with a sheet guide 20*b*, which forms a part of the two-sided image formation passage 19. A part of the sheet guide 20*b* is provided with multiple third openings 53 which are distributed across the entirety of the door 20 in the direction parallel to the widthwise direction of the sheet 21 (FIG. 4). By the way, the widthwise direction of the sheet 21 is the direction perpendicular to the direction in which the sheet 21 is conveyed.

As the door 20 is pivotally moved about its hinge 20*a* (FIG. 1) in a manner to be moved away from the apparatus main assembly 1*a*, that is, as the door 20 is opened, the combination of the sheet guide 20*b* and follower roller 29*b* separates, together with the door 20, from the combination of the sheet guide 19*a* and driving roller 29*a*, with which the apparatus main assembly 1*a* is provided. Thus, it becomes possible to remove a jammed sheet in the two-sided image formation passage 19. As the door 20 is pivotally moved about its hinge portion 20*a* to be shut against the apparatus main assembly 1*a*, that is, as the door 20 is closed, the sheet guide 20*b* opposes, together with the door 20, the sheet guide 19*a*, with which the apparatus main assembly 1*a* is provided. Further, the follower roller 29*b* is pressed upon the driving roller 29*a*, forming thereby a nip between the pair of sheet conveyance rollers 29 (driving rollers 29*a* and 29*b*).

The two-sided image formation passage 19 is provided with a sheet sensor 30*c*, which is disposed in the preset position in the passage 19 (FIG. 1). As the flag 30*c* of the sheet sensor 30*c* is pushed downward by the sheet 21 to the position indicated by a dotted line in FIG. 1, the unshown control portion determines that the sheet 21 is being correctly conveyed.

After being conveyed through the two-sided image formation passage 19, the sheet 21 is guided upside down to the pair of registration rollers 5. Then, it is conveyed through the secondary transfer nip N2 and fixing apparatus 14. Thereafter, the flapper 15 is pivoted into the position indicated by the solid line in FIG. 1. Therefore, the sheet 21, which is bearing an image on both of its surfaces, is conveyed toward the pair of discharge rollers 16, and then, is discharged onto the delivery tray 18 by the pair of discharge rollers 16.

<Air Blowing Apparatus>

Figure 3:
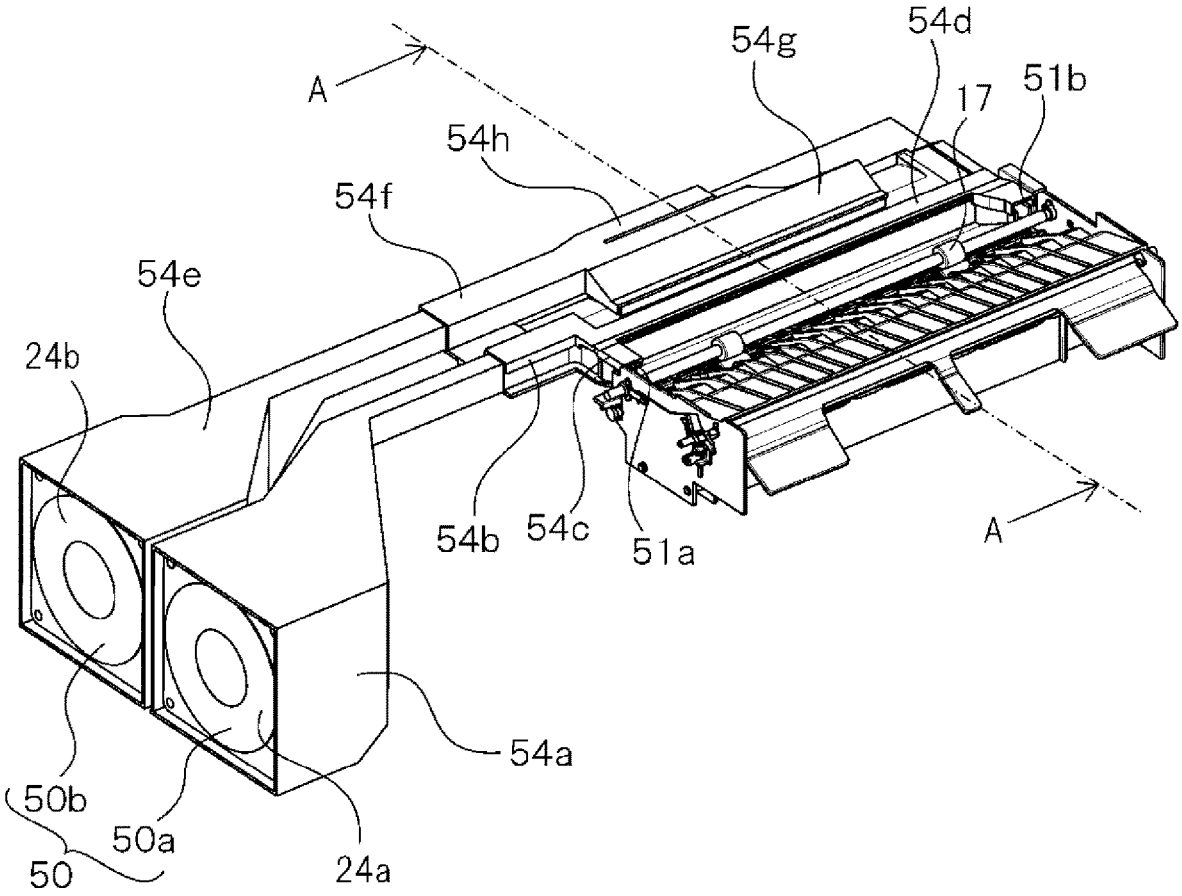
FIG. 3 is a perspective view of a combination of the air blowing apparatus, air ducts which are in connection to the air blowing apparatus, and discharging apparatus in the first embodiment; it shows the structure of the ducts.
Figure 5:
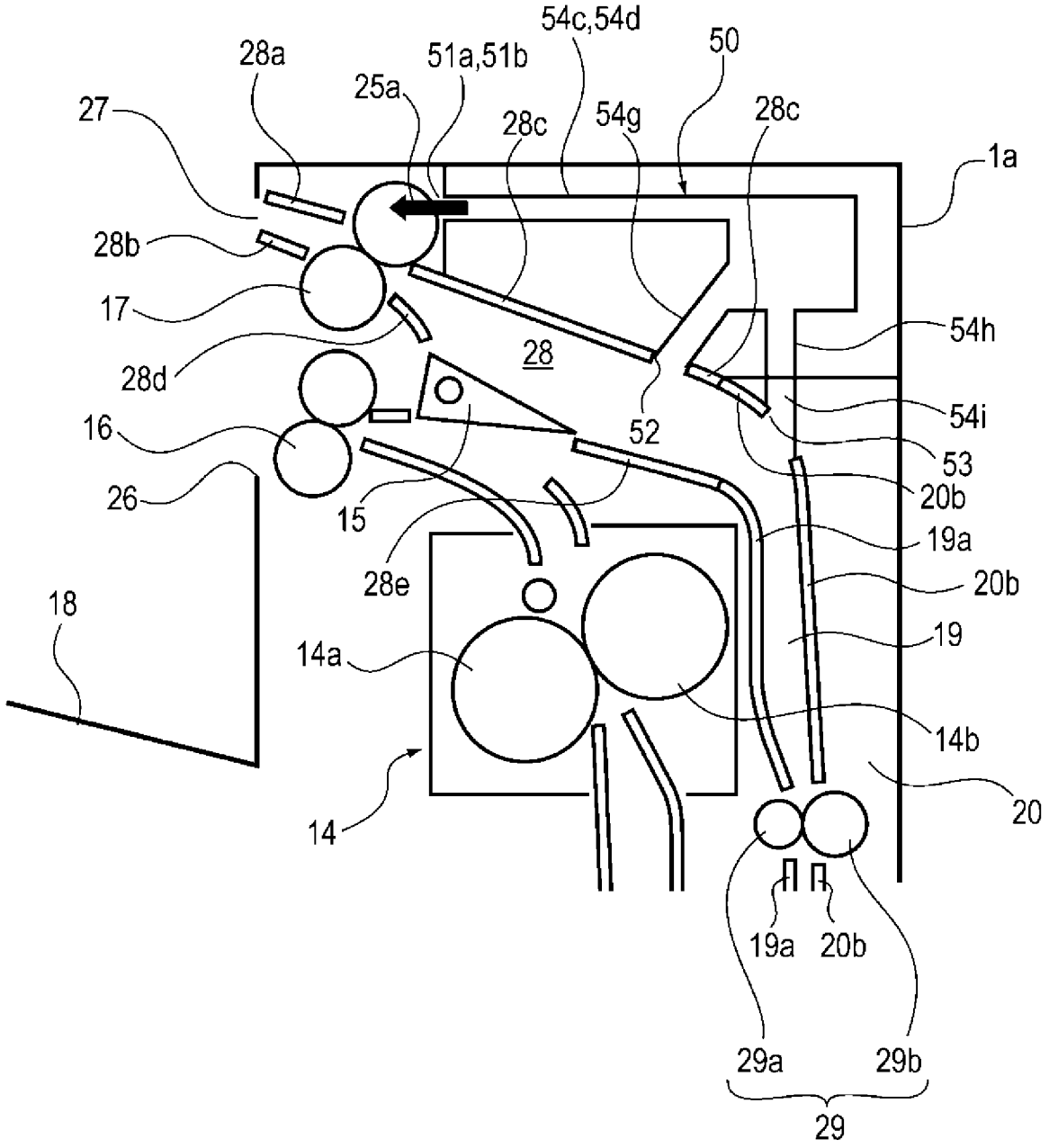
FIG. 5 is a sectional view of the top-right portion of the image forming apparatus in the first embodiment; it shows the airflow from the first opening.
Figure 6:
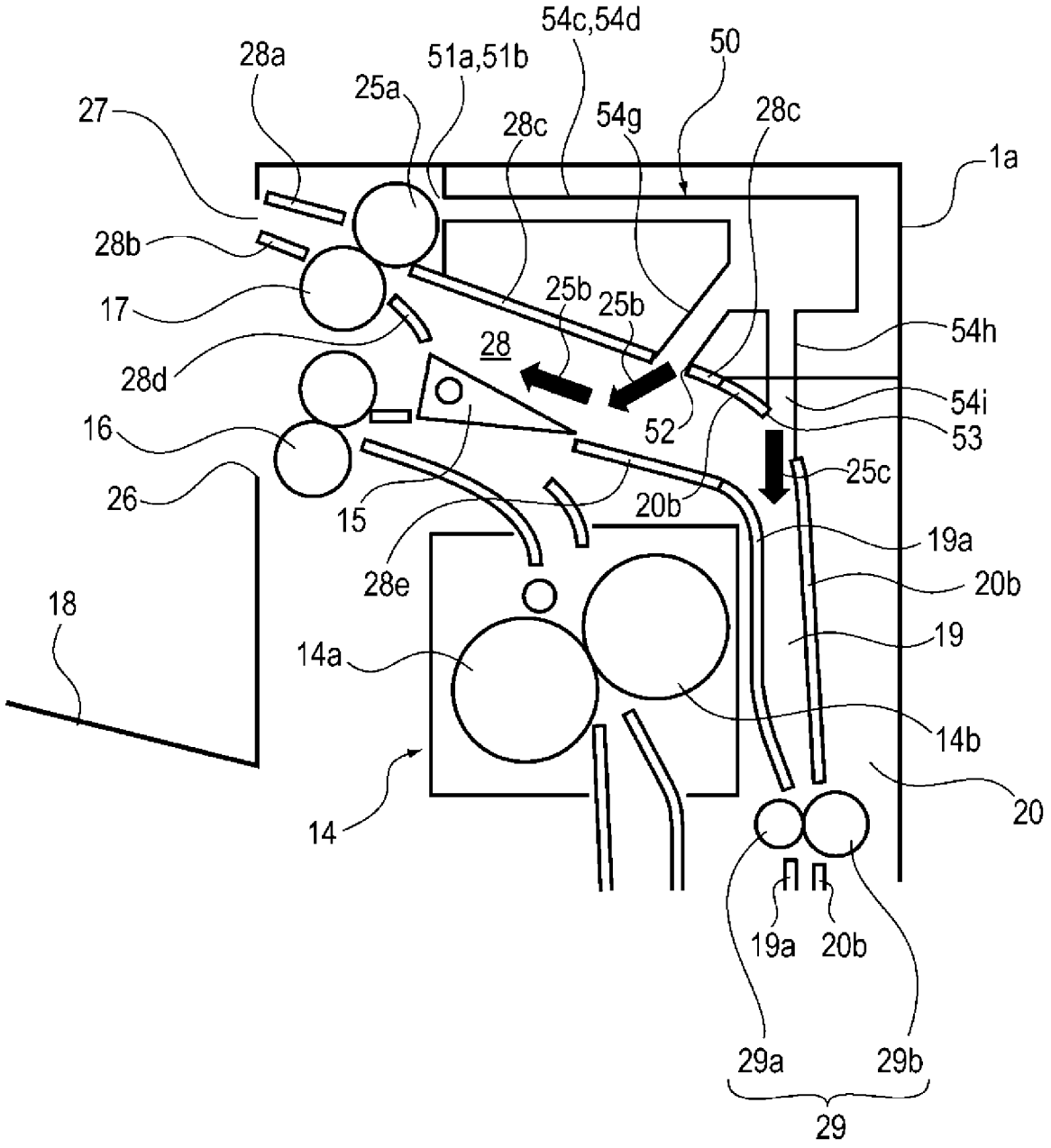
FIG. 6 is a sectional view of the top-right portion of the image forming apparatus in the first embodiment; it shows the airflows from the second and third openings.

Next, referring to FIGS. 3-6, an air blowing apparatus 50 as a means for generating airflow, and the air passages of the image forming apparatus 1, are described about their structure. FIG. 3 is a perspective view of the various ducts which are in connection to the air blowing apparatus 50. It shows the structure of the ducts. FIG. 4 is a perspective view of the ducts, which are visible as they are cut at a plane A-A in FIG. 3. FIG. 5 is a sectional view of the top-right portion of the image forming apparatus 1. It shows the airflow from the first openings 51*a* and 51*b*. FIG. 6 is also a sectional view of the top-right portion of the image forming apparatus 1. It shows the airflow from the second openings 52 and 53. Referring to FIG. 3, the air blowing apparatus 50 comprises the first and second blowing apparatuses 50*a* and 50*b*, respectively, which are disposed side by side in one of the end portions of the image forming apparatus 1, in terms of the widthwise direction of the sheet 21.

The first air blowing apparatus 50*a* takes in the ambient air of the image forming apparatus 1 by its fan 24*a*, and sends the ambient air into a duct 54*a*. The fan 24*a* is an axial flow fan which suctions the ambient air from one end of its rotational axle, and sends to the other end, the air which it suctioned. The duct 54*a* extends in the direction parallel to the widthwise direction of the sheet 21. The duct 54*a* is shaped so that a shroud in which it is disposed gradually reduces in cross-sectional dimension from where the fan 24*a* is, toward where it is in connection to the duct 54*b*, being smallest in the cross-sectional size at the joint between itself and duct 54*b*. The duct 54*a* is in connection to the duct 54*b* which extends in the direction parallel to the widthwise direction of the sheet 21. The duct 54*b* bifurcates into the ducts 54*c* and 54*d*. The duct 54*c* extends from the duct 54*b* at a preset angle, extending in the direction in which the sheet 21 is conveyed.

A duct 54*d* extends from a duct 54*b* at a preset angle like a crank, and extends further in the direction parallel to the widthwise direction of the sheet 21. It is long enough to extend across the entirety of the sheet 21 in terms of the widthwise direction of the sheet 21. A duct 54*c*, which bifurcates from the duct 54*b*, bends again at a point which corresponds to the other end of the sheet passage in terms of the widthwise direction of the sheet 21, and extends further in the direction in which the sheet 21 is conveyed.

The duct 54*c* is provided with a first opening 51*a*, which corresponds in position to one end (edge) of the sheet 21 in terms of the widthwise direction of the sheet 21. It is structured so that air is sent upstream by the fan 24*a*, in terms of the direction in which the sheet 21 is conveyed after being reversed in conveyance direction by the reversal roller 17. The duct 54*d* is provided with the first opening 51*b*, which corresponds in position to the other end (edge) of the sheet 21 in terms of the widthwise direction of the sheet 21. It is structured so that air is sent upstream by the fan 24*a* from the downstream side in terms of the direction in which the sheet 21 is conveyed after being reversed in conveyance direction by the reversal roller 17.

The second air blowing apparatus 50*b* takes in the ambient air of the image forming apparatus 1 by a fan 24*b*, and sends the ambient air into the duct 54*e*. The fan 24*b* is an axial flow fan. It suctions air from one end and sends the air to the other end. The duct 54*e* extends in the direction parallel to the widthwise direction of the sheet 21. The duct 54*e* is shaped so that it gradually reduces in cross-sectional dimension from where the fan 24*b* is, toward where it is in connection to the duct 54*f*, being therefore smallest in cross-sectional dimension at the joint between itself and the duct 54*f*.

The duct 54*e* is in connection to the duct 54*f*, which extends in the direction parallel to the widthwise direction of the sheet 21. The duct 54*f* bifurcates into ducts 54*g* and 54*h* which extend in the direction parallel to the widthwise direction of the sheet 21. The ducts 54*g* and 54*h* branch from the duct 54*f*, and extend roughly in parallel in the direction parallel to the widthwise direction of the sheet 21.

The duct 54*g* which branches from the duct 54*f* has such a length that is enough for the duct 54*g* to extend from one end (edge) of the sheet 21 to the other in terms of the widthwise direction of the sheet 21. It is in connection to the second openings 52, with which a part of a sheet guide 28*c* shown in FIG. 4 is provided. Referring to FIG. 4, the sheet guide 28*c* is provided with multiple second openings 52, which are distributed at a preset pitch across rough the entirety of the sheet guide 28*c* in the direction parallel to the widthwise direction of the sheet 21. The duct 54*h*, which branches from the duct 54*f* shown in FIG. 3 is in connection to a duct 54*i*, with which the door 20 is provided, as shown in FIGS. 2 and 4. The duct 54*i* is in connection to the third openings 54, with which the sheet guide 20*b* is provided. Referring to FIG. 4, the sheet guide 20*b* is provided with multiple third openings 53, which are distributed at a preset pitch across roughly the entirety of the sheet guide 20*b* in terms of the widthwise direction of the sheet 21.

The ducts 54*a*, 54*b*, 54*c* and 54*d* shown in FIG. 3 guide the air sent from the fan 24*a*, as an air blowing means, toward the end portions of the reversal roller 17 in terms of the direction parallel to the axis of the reversal roller 17, from the first openings 51*a* and 51*b*. The ducts 54*e*, 54*f* and 54*g* shown in FIGS. 2-4 guide the air sent from the fan 24*b*, as an air blowing means, into the internal space of the reversal conveyance passage 28, through the second openings 52. The ducts 52*e*, 54*f*, 54*h* and 54*i* guide the air sent from the fan 24*b* as an air blowing means, into the internal space of the two-sided image formation passage 19 through the third openings 53.

<Openings>

Referring to FIGS. 2 and 3, the top portion of the reversal conveyance passage 28 is provided with the first openings 51*a* and 51*b*, which are positioned at the lengthwise ends, one for one, of the top wall of the duct 54, and on reversal roller side. The first openings 51*a* and 51*b* open toward the direction in which the sheet 21 is conveyed. Further, referring to FIGS. 2 and 4, the top portion of the reversal conveyance passage 28 is provided with the second openings 52, which are distributed across the entirety of the top portion in the direction parallel to the widthwise direction of the sheet 21. The openings 52 open in the downstream direction, in terms of the direction parallel to the direction in which the sheet 21 is conveyed in the internal space of the reversal conveyance passage 28. The second openings 52 belong to the sheet guide 28*c* which guides the sheet 21 by the top side of the sheet 21 as the sheet 21 is conveyed through the reversal conveyance passage 28.

Referring to FIG. 3, air is blown toward the lengthwise end portions of the reversal roller 17 in terms of the direction parallel to the axial line of the reversal roller 17, from the first openings 51*a* and 51*b* of the ducts 54*c* and 54*d*, respectively. Next, referring to FIG. 5, the first openings 51*a* and 51*b* are positioned at the front and rear end portions of the apparatus main assembly 1*a*, respectively, to blow air in the upstream direction (right to left, in FIG. 5), from the downstream side, in terms of the direction in which the sheet 21 is conveyed after being reversed in conveyance direction by the reversal roller 17. The first openings 51*a* and 51*b* belong to the top portion of the reversal conveyance passage 28, and are positioned on the opposite side of the fixing apparatus 14 from the area through which the sheet 21 is conveyed by the reversal roller 17.

The second openings 52, shown in FIGS. 4 and 6, with which the sheet guide 28*c* is provided, are in connection to the duct 54*g*, and are open in the internal space of the reversal conveyance passage 28. The second openings 52 are positioned to send air 25*b* toward the reversal roller 17, in the upstream direction (right to left in FIG. 6) from the downstream side, in terms of the direction in which the sheet 21 is conveyed after being reversed in conveyance direction, across the entirety of the sheet 21 in terms of the widthwise direction of the sheet 21 while the sheet 21 is in the internal space of the reversal conveyance passage 28.

The third openings 53 which belong to the sheet guide 20*b* shown in FIGS. 4 and 6 are in connection to the duct 54*i*, opening thereby in the internal space of the two-sided image formation passage 19. The third openings 54 are positioned on the downstream side of the second openings 52, in terms of the direction in which the sheet 21 is conveyed after being reversed in conveyance direction by the reversal roller 17. The third openings 53 are positioned to send air 25*c* downstream (from upstream side toward downstream in FIG. 6), across the entire range of the internal space of the two-sided image formation passage 19, from the upstream side in terms of the direction in which the sheet 21 is conveyed after being reversed in conveyance direction by the reversal roller 17.

<Airflow>

Next, referring to FIGS. 5 and 6, the airflow in the image forming apparatus 1 is described. FIG. 5 is a sectional view of the top-right portion of the image forming apparatus 1. It shows the direction in which the air 25*a* from the first openings 51*a* and 51*b* flows. FIG. 6 also is a sectional view of the top-right portion of the image forming apparatus 1. It shows the flows of air 25*b* and 25*c* from the second and third openings 52 and 53, respectively. As the air 25*a* is sent from the air blowing apparatus 50*a*, it comes out of the first openings 51*a* and 51*b*, as shown in FIG. 5. Then, it flows as two air flows toward the lengthwise end portions of the reversal roller 17 in the direction parallel to the rotational axis of the reversal roller 17.

The air flows 25*b* and 25*c* sent from the air blowing apparatus 50*b* shown in FIG. 3 come out of the second and third openings 52 and 53, respectively, as shown in FIG. 6. The duct 54*g* is shaped and positioned so that it turns upstream, in terms of the direction in which the sheet 21 is conveyed in the reversal conveyance passage 28, immediately before the second opening 52. Therefore, as the air 25*b* comes out of the second openings 52, it flows upstream in terms of the direction in which the sheet 21 is conveyed toward the two-sided image formation passage 19. Therefore, the air in the reversal conveyance passage 28, which is on the top side of the fixing apparatus 14, is made to flow toward the reversal roller 17 by being pushed by the air 25*b*, and then, is discharged from the image forming apparatus 1.

On the other hand, as the air 25*c* is blown out of the third opening shown in FIG. 6, it flows from the upstream side toward the downstream side through the two-sided image formation passage 19, across the entirety of the two-sided image formation passage 19, in terms of the widthwise direction of the sheet 21, and flows into the internal space of the image forming apparatus 1, while scattering water vapor away. Referring to FIG. 5, since the air 25*a* is sent toward the lengthwise end portions of the reversal roller 17 in terms of the direction parallel to the axial line of the reversal roller 17, the air in the adjacencies of the lengthwise end portions of the reversal roller 17 is discharged out of the image forming apparatus 1. By the way, the first openings 51*a* and 51*b* are parts of the top portion of the reversal conveyance passage 28. Therefore, even if the sheet 21 is in the adjacencies of the reversal roller 17 while the image forming apparatus 1 is in the two-sided image forming operation, the air 25*a* flows above the sheet 21, and then, is discharged out of the image forming apparatus 1.

Further, referring to FIG. 6, by sending the air 25*b* into the internal space of the reversal conveyance passage 28 through the second openings 52, it is possible to discharge the water vapor on the top side of the fixing apparatus 14, out of the image forming apparatus 1, and also, to prevent the water vapor from condensing on the sheet guides, flapper 15, etc., which guide the sheet 21. Further, by sending the air 25*c* into the internal space of the two-sided image formation passage 19 through the third openings 53, it is possible to prevent the condensation of the water vapor on the sheet guides, pair of sheet conveyance rollers 29, etc., which guide the sheet 21 while the sheet 21 is conveyed through the two-sided image formation passage 19.

Therefore, it is possible to prevent the problem that when the image forming apparatus 1 is in the two-sided image formation mode, it outputs such an image that is defective in that parts of the image are missing because of the wetting of the sheet 21 attributable to condensation. Further, it is possible to prevent the problem that as water vapor is discharged toward the delivery tray 18 from the adjacencies of the lengthwise end portions of the reversal roller 17 in terms of the direction parallel to the axial line of the reversal roller 17, it exceeds the dew point in water content, and therefore, turns into steam. Therefore, it is possible to prevent the problem that as a user sees the steam coming out of the image forming apparatus 1, the user might misunderstand that the image forming apparatus 1 is malfunctioning.

Further, even if the image forming apparatus 1 is increased in the speed with which the sheet 21 is conveyed, and also, in productivity, it is possible to prevent the problem that it outputs such an image that is defective in that parts of the image are missing because of the wetting of the sheet 21 by condensation. Moreover, it is possible to prevent the problem that steam comes out of the sheet discharge opening 27, which is in the adjacencies of the reversal roller 17, and therefore, it is possible to prevent the problem that as a user of the image forming apparatus 1 sees the steam coming out of the opening 27, he or she thinks that the image forming apparatus 1 is malfunctioning.

Embodiment 2

Figure 7:
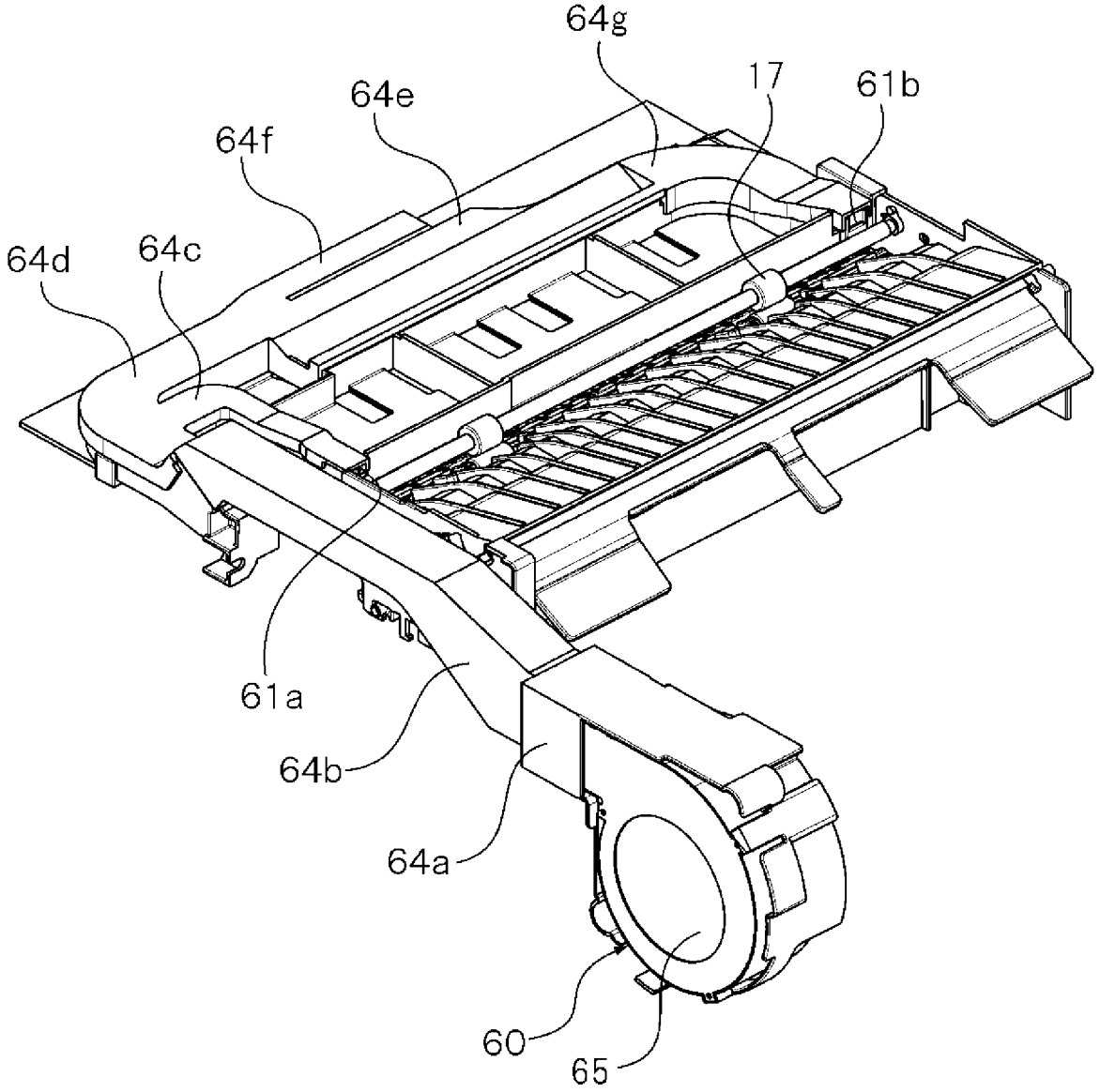
FIG. 7 is a perspective view of an airflow generating apparatus in the second embodiment of the present invention; it shows the structure of the air ducts which are in connection to the airflow generating apparatus.

Next, referring to FIG. 7, the image forming apparatus 1 in the second embodiment of the present invention is described about its structure. By the way, the components, portions thereof, etc., of the image forming apparatus 1 in the second embodiment, which are similar in structure to the counterparts in the first embodiment, are given the same referential codes, and/or the same name, and are not described here. FIG. 7 is a perspective view of the ducts 64*a*-64*g* which are in connection to the air blowing apparatus 60, as an air blowing means, in this embodiment. It shows the structure of the ducts. By the way, the second openings 52 and the third openings 53 in this embodiment are similar in structure as the counterparts in the first embodiments, shown in FIGS. 2, and 4-6, which were described above. Therefore, they are not described here.

Referring to FIG. 7, the air blowing apparatus 60 is a means for blowing air. It is provided with a fan 65, which is positioned at one end of the air blowing apparatus 60 in terms of the widthwise direction of the sheet 21. The air blowing apparatus 60 blows into the duct 64*a*, the air it has taken in with the use of its fan 65. The fan 65 is centrifugal fan, which suctions air from its shaft side and sends toward its peripheral side. The duct 64*a* is in connection to a duct 64*b*, which is positioned at one end of the image forming apparatus 1 in terms of the widthwise direction of the sheet 21, and extends in the direction in which the sheet 21 is conveyed.

In the case of the air blowing apparatus 50*a* shown in FIG. 3, the ducts 54*a* and 54*b* are positioned so that they extend outward in the widthwise direction of the sheet 21, beyond the recording medium passage in terms of the widthwise direction of the sheet 21. Therefore, the employment of the air blowing apparatus 50*a* increases the image forming apparatus 1 in dimension in terms of the widthwise direction of the sheet 21. In comparison, in the case of the air blowing apparatus 60 shown in FIG. 7, the fan 65 and ducts 64*a* and 64*b* extend in the direction parallel to the direction in which the sheet 21 is conveyed. Therefore, the employment of this air blowing apparatus 60 can reduce the image forming apparatus 1 in dimension in terms of a direction orthogonal to the direction in which the sheet 21 is conveyed, in comparison to the case in which the air blowing apparatus 50 shown in FIG. 3 is employed. However, it increases the image forming apparatus 1 in dimension in terms of the direction in which the sheet 21 is conveyed.

Referring to FIG. 7, the duct 64*b* bifurcates into the ducts 64*c* and 64*d*. The duct 64*c* extends in manner to make a U-turn at the point at which it divides from the duct 64*b*, and in parallel to the direction in which the sheet 21 is conveyed, that is, in parallel to the duct 64*b*. The first opening 61*a* of the duct 64*c* is positioned at one end of the recording medium passage in terms of the widthwise direction of the sheet 21.

The first opening 61*a* is positioned to send air from the downstream side toward the upstream side in terms of the direction in which the sheet 21 is conveyed after being reversed in conveyance direction by the reversal roller 17. The duct 64*d* branches from the duct 64*b* in the direction which is roughly parallel to the widthwise direction of the sheet 21, and extends in the widthwise direction of the sheet 21.

A duct 64*e* is in connection to the second opening 52, with which a part of the sheet guide 28*c* is provided in the first embodiment as shown in FIG. 4. It is also in connection to the duct 64*g* which extends in the widthwise direction of the sheet 21, in parallel to the duct 64*e*. The first opening 64*b* is at the other end of the sheet passage in terms of the widthwise direction of the sheet 21. The duct 64*b* is positioned so that air is sent from the downstream side toward the upstream side in terms of the direction in which the sheet 21 is conveyed after being reversed in conveyance direction by the reversal roller 17. A duct 64*f* is in connection to the third opening 53, with which a part of the sheet guide 20*b* is provided, by way of the duct 54*i*, with which the door 20 is provided in the first embodiment, as shown in FIG. 4.

The ducts 64*a*, 64*b*, 64*c*, 64*d*, 64*e* and 64*g*, shown in FIG. 7, guide the air sent from the fan 65, as an air blowing means, from the first openings 61*a* and 61*b*, toward each of the lengthwise end portions of the reversal roller 17 in terms of the direction of the rotational axis of the reversal roller 17. The ducts 64*a*, 64*b*, 64*d* and 64*e* guide the air sent from the fan 65, as an air blowing means, into the internal space of the reversal conveyance passage 28 through the second opening (FIG. 4). The ducts 64*a*, 64*b*, 64*d*, 64*f* and 54*i* guide the air sent from the fan 65, as an air blowing means, into the internal space of the two-sided image formation passage 19, through the third opening 53 (FIG. 4).

Since the air blowing apparatus 60 takes in the ambient air of the image forming apparatus 1, and blows the ambient air into the image forming apparatus 1, air blows out of each of the first openings 61*a* and 61*b*, second opening 52, and third opening 53. The duct 64*b* bifurcates in such a manner that air is sent by the fan 65, as an air blowing means, to each of the first openings 61*a* and 61*b*, the second openings 52, and the third opening 53.

<Openings>

Each of the ducts 64*c*, and first openings 61*a* and 61*b* of the duct 64*g* opens toward the lengthwise end portions of the reversal roller 17 in terms of the direction parallel to the axial line of the reversal roller 17. Each of the first openings 61*a* and 61*b* is positioned at the widthwise end portions of the sheet 21, one for one, to send the air 25*a* from the downstream side toward the upstream side (right to left in FIG. 5) in terms of the direction in which the sheet 21 is conveyed after being reversed in conveyance direction by the reversal roller 17. Each of the first openings 61*a* and 61*b* is positioned on the opposite side of the fixing apparatus 14 from the recording medium passage through which the sheet 21 is conveyed by the reversal roller 17, and also, on the top side of the reversal conveyance passage 28.

The second opening 52, which is a part of the sheet guide 28*c*, is in connection to the duct 64*e*, shown in FIG. 7, as it is shown in FIG. 6, and opens in the internal space of the reversal conveyance passage 28. The second opening 52 is positioned to send the air 25*b* from the downstream side toward the upstream side (right to left in FIG. 6) in terms of the direction in which the sheet 21 is conveyed after being reversed in conveyance direction by the reversal roller 17, across the entirety of the internal space of the reversal conveyance passage 28 in terms of the widthwise direction of the sheet 21.

The third opening 53, which is a part of the sheet guide 20*b*, is in connection with the duct 54*i*, and is open in the internal space of the two-sided image formation passage 19, as it is in FIG. 6. The third opening 53 is positioned to send the air 25*c* from the upstream side toward the downstream side (top side to bottom side in FIG. 6) in terms of the direction in which the sheet 21 is conveyed after being reversed in conveyance direction by the reversal roller 17, across the entirety range of the recording medium passage in terms of the widthwise direction of the sheet 21.

The air blowing apparatus 60, first openings 61*a* and 62*b*, and the second and third openings 52 and 53, respectively, shown in FIG. 4, and each of the ducts which are in connection to these openings, are positioned as shown in FIG. 7. Therefore, the problem that water vapor condenses and adheres to the reversal conveyance passage 28, which is on the top side of the fixing apparatus 14, the two-sided image formation passage 19, which is on the outward side of the fixing apparatus 14, etc., can be prevented by the employment of the air blowing means which is substantially smaller in measurement in terms of the widthwise direction of the recording medium passage. Therefore, the problem that the sheet 21 is wetted as it is conveyed through the image forming apparatus 1, and/or the image forming apparatus 1 outputs an image, the parts of which are missing, when the image forming apparatus 1 is in the two-sided image formation mode, can be prevented. Further, it is possible to prevent the problem that as water vapor is discharged toward the delivery tray 18 from the adjacencies of the lengthwise end portions of the reversal roller 17 in terms of the direction parallel to the axial line of the reversal roller 17, it exceeds the dew point, and therefore, the water vapor turns into steam. Therefore, it is possible to prevent the problem that as a user sees the steam coming out of the image forming apparatus 1, the user might misunderstand that the image forming apparatus 1 is malfunctioning. The components of the image forming apparatus 1 in this embodiment, and the portions thereof, other than those described above, are the similar in structure, and are similar in effect.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-139598 filed on Jul. 30, 2019, which is hereby incorporated by reference herein in its entirety.

What is claimed is:

1. An image forming apparatus comprising:

an image forming portion for forming a toner image on a recording material;

a fixing portion configured to fix the toner image formed by said image forming portion on the recording material;

a reversing portion configured to reverse the recording material carrying the toner image fixed by said fixing portion;

a blower configured to blow air;

a duct for guiding the air blown from said blower to said reversing portion; and a feeding path configured to guide the recording material reversed by said reversing portion to said image forming portion, wherein said duct is provided with (a) a first opening at an end in a width direction of the recording material, said blower blowing the air from a downstream side to an upstream side with respect to the feeding direction of the recording material after being reversed by said reversing portion, (b) a second opening configured to supply the air from the downstream side to the upstream side with respect to the feeding direction of the recording material after being reversed by said reversing portion and toward said reversing portion over an entire width of the recording material in said feeding path, and (c) a third opening provided on a downstream side of the second opening in the feeding direction of the recording material after being reversed by said reversing portion, and being located so as to supply air from the upstream side to the downstream side over the entire width of the recording material in the feeding direction of the recording material after being reversed by said reversing portion.

2. An image forming apparatus according to claim 1, wherein said first opening is formed on a side opposite to said fixing portion with respect to the recording material when the recording material is fed by said reversing portion.

3. An image forming apparatus according to claim 1, wherein said duct is branched so as to supply the air from said blower to said first opening, said second opening, and said third opening.

4. An image forming apparatus comprising:

an image bearing member configured to bear a toner image;

a transfer member configured to transfer the toner image from said image bearing member onto a recording material;

a fixing unit configured to fix the transferred toner image on the recording material;

a reversing roller configured to reverse the recording material on which the toner image has been fixed by said fixing unit;

a fan, provided at one end of said image forming apparatus with respect to an axial direction of said reversing roller, configured to suction air from outside of said image forming apparatus and blow the air into said image forming apparatus; and a duct system configured to guide the air blown from said fan, wherein said duct system includes a first duct provided with a first opening portion at the one end with respect to the axial direction and a second duct, bifurcated from said first duct, provided with a second opening portion at the other end with respect to the axial direction, and wherein said second duct is not provided with an opening between said first duct and said second opening portion, and said first opening portion and said second opening portion are positioned downstream of said reversing roller with respect to a reverse feeding direction of the recording material reversed by said reversing roller.

5. An image forming apparatus comprising:

an image bearing member configured to bear a toner image;

a transfer member configured to transfer the toner image from said image bearing member onto a recording material;

a fixing unit configured to fix the transferred toner image on the recording material;

a reversing roller configured to reverse the recording material on which the toner image has been fixed by said fixing unit;

a fan, provided at one end of said image forming apparatus with respect to an axial direction of said reversing roller, configured to suction air from outside of said image forming apparatus and blow the air into said image forming apparatus; and a duct system configured to guide the air blown from said fan, wherein said duct system includes a first duct provided with a first opening portion at the one end with respect to the axial direction, a second duct, bifurcated from said first duct, provided with a second opening portion at the other end with respect to the axial direction, and a third duct, bifurcated from said second duct, provided with a third opening portion with respect to the axial direction, and wherein said first opening portion and said second opening portion are positioned downstream of said reversing roller with respect to a reverse feeding direction of the recording material reversed by said reversing roller.

6. An image forming apparatus according to claim 5, wherein said second duct is provided with a fourth opening portion at a center location with respect to the axial direction.

7. An image forming apparatus according to claim 6, wherein said fourth opening portion is positioned upstream of said third opening portion with respect to the reverse feeding direction.

8. An image forming apparatus according to claim 7, further comprising a reverse feeding passage configured to guide the recording material reversed by said reversing roller to said image bearing member and to a transfer nip region formed by said transfer member again, wherein said fourth opening portion and said third opening portion are opposed to the recording material passing through said reverse feeding passage, and wherein the air supplied from said fan to said reverse feeding passage through said fourth opening portion and said third opening portion cools the recording material passing through said reverse feeding passage.

9. An image forming apparatus according to claim 8, wherein said fourth opening portion is configured to supply the air supplied from said fan from a downstream side to an upstream side with respect to the reverse feeding direction.

10. An image forming apparatus according to claim 8, wherein said third opening portion is configured to supply the air supplied from said fan from an upstream side to a downstream side with respect to the reverse feeding direction.

* * * * *